United States Patent [19]

Fischer et al.

[11] 4,288,668

[45] Sep. 8, 1981

[54] CIRCUIT INTERRUPTER USING A MINIMUM OF DIELECTRIC LIQUID

[75] Inventors: William H. Fischer, Pittsburgh; Charles F. Cromer, Trafford; Joseph R. Rostron, Murrysville, all of Pa.

[73] Assignee: Electric Power Research Institute, Inc., Palo Alto, Calif.

[21] Appl. No.: 121,165

[22] Filed: Feb. 13, 1980

Related U.S. Application Data

[63] Continuation of Ser. No. 826,382, Aug. 22, 1977.

[51] Int. Cl.[3] ..... H01H 33/75

[52] U.S. Cl. ..... 200/150 G; 200/148 A

[58] Field of Search ..... 200/150 G, 148 A, 148 B, 200/148 E, 148 G, 150 R

[56] References Cited

U.S. PATENT DOCUMENTS

| | | | |
|---|---|---|---|
| 2,061,945 | 11/1936 | Koppelmann et al. | 200/148 E |
| 3,150,245 | 9/1964 | Leeds et al. | 200/148 G |
| 3,406,269 | 10/1968 | Fischer | 200/148 G |

*Primary Examiner*—Robert S. Macon

*Attorney, Agent, or Firm*—Flehr, Hohbach, Test, Albritton & Herbert

[57] ABSTRACT

A minimum liquid circuit interrupter provides a relatively remote cooled storage unit for the dielectric liquid and fills a cylinder which is in close proximity to the insulating nozzle of the interrupter, the cylinder being driven at one end by a piston and closed at the other by the moving contact of the interrupter.

7 Claims, 6 Drawing Figures

CIRCUIT INTERRUPTER USING A MINIMUM OF DIELECTRIC LIQUID

This is a continuation, of application Ser. No. 826,382 filed Aug. 22, 1977.

BACKGROUND OF THE INVENTION

The present invention is directed to a circuit interrupter using a minimum of dielectric liquid and more specifically to an interrupter as above where the liquid is substantially maintained in that state under all operating conditions.

Several liquid sulphur hexachloride ($SF_6$) circuit breaker designs were developed in the late 1950s as, for example, illustrated in Leeds et al U.S. Pat. No 3,150,245. The difficulty with the Leeds design was that because of the low critical temperature (114° F.) of a typical dielectric liquid such as $SF_6$ the storage vessel had to be designed for a pressure of 2,000 psi. Critical temperature is defined as that temperature above which increases in pressure will not liquify the gas. Moreover, many times the interrupter also had to be designed for both the gas and liquid phases because of this low critical temperature.

As disclosed in copending application Ser No. 818,004, filed July 22, 1977, entitled "Circuit Interrupter Using Dielectric Liquid With Energy Storage" and assigned to the present assignee the use of dielectric liquid such as $SF_6$ to extinguish arcs in an interrupter is disclosed. A similar type structure is also disclosed.

OBJECTS AND SUMMARY OF THE INVENTION

It is therefore an object of the present invention to provide an improved liquified-gas circuit interrupter.

It is a more specific object to minimize the amount of liquid needed for circuit interruption and also to substantially maintain it in the liquid phase.

In accordance with the above objects there is provided a circuit interrupter using a minimum of dielectric liquid. Fixed contact means are provided. An electrical and thermal insulating nozzle has a nozzle throat. A movable contact is inserted in the nozzle throat through and into electrical contact with the fixed contact means. An insulated cylinder contains the liquid having one end connected to the nozzle and the other end to a pump piston. Liquid storage means fill the cylinder with the liquid at a relatively slow rate. Valve means gate the cylinder and nozzle for allowing the pump piston to cause the liquid to flow through the nozzle throat at a relatively high rate.

DETAILED DESCRIPTION OF THE PREFERRED EMBODIMENTS

Figure 1:
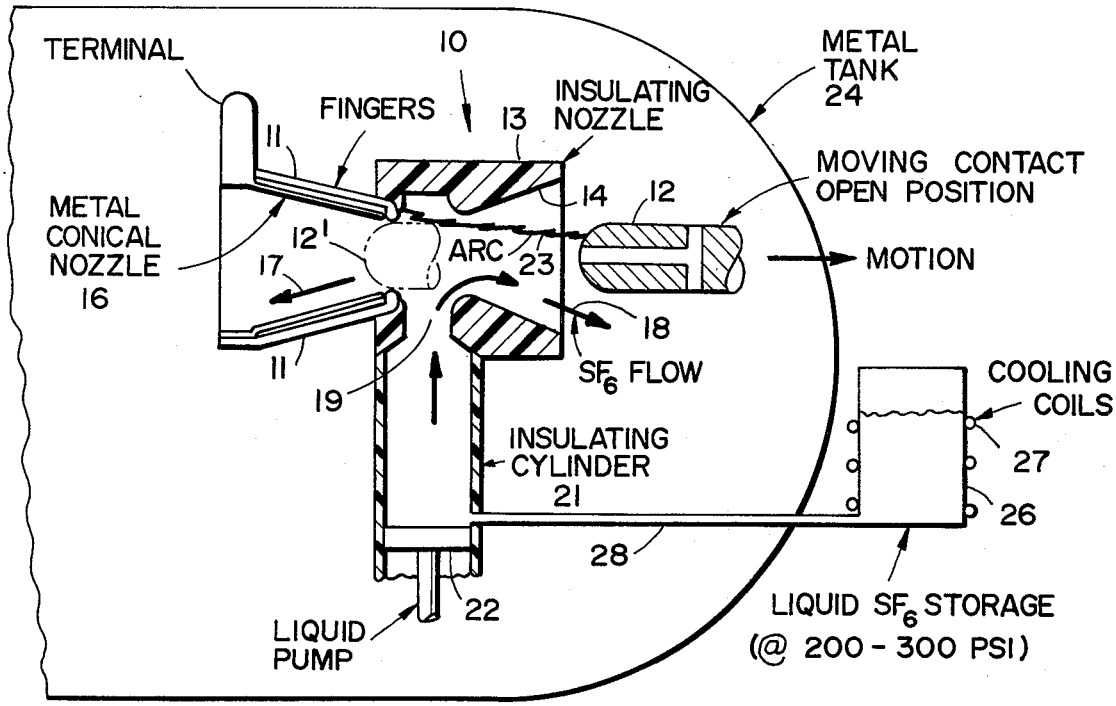
FIG. 1 is a simplified diagram of an interrupter embodying the present invention.

Referring to FIG. 1, an interrupter 10 is shown having fixed contacts 11 which are in the form of fingers and a moving contact 12 shown in its open position. An electrical and thermal insulating nozzle 13 (which may be made of TEFLON (trademark) material) receives in the nozzle throat 14 the moving contact 12 which is shown in dashed outline 12' in its closed condition contacting the end of fingers 11 which are affixed to a nozzle 13. Fixed contact fingers 11 surround a metal truncated conical nozzle 16 which forms an additional flow path 17 for the $SF_6$ liquid flow in addition to the flow path 18 through the nozzle throat 14 toward the open contact 12. An entrance port or aperture 19 is formed in the side of insulating nozzle 13 and an insulating cylinder 21 is connected to the aperture 19. The end of cylinder 21 has movable within it a liquid pump piston 22 which has a pump operator (not shown) to drive the liquid contained in the cylinder through aperture 19 and into the flow path 18 to interrupt the arc 23 and also the flow path 17. With moving contact 12' inserted in contact with the fixed contacts 11 port 19 is effectively sealed thus forming a type of valve. However when moved to its open position it allows the liquid to be pumped into the nozzle throat at a relatively high rate to effectively extinguish arc 23.

The entire assembly thus far described is normally enclosed in a pressurized or air tight metal tank 24.

Cylinder 21 is filled at its bottom with dielectric liquid from a storage unit 26 provided with cooling coils 27. A pipeline 28 connects the storage unit 26 with cylinder 21 with appropriate valving (not shown). With the cooled storage unit 26, liquid $SF_6$ may be stored at a reasonable pressure of 200 to 300 psi minimizing construction costs since high pressure retention vessel construction techniques are not required. In other words, the cooling coils 27 maintain the $SF_6$ in its liquid phase at all times. In addition, if the liquid $SF_6$ is maintained at a low enough temperature of for example 35° F. it has a density of 95.5# per cubic foot to thus to enhance its effectiveness in interrupting high current arcs.

Storage tank 26 fills the insulating cylinder 21 at a relatively slow rate compared to the outflow through port 19 to thus maintain the liquid in its desired liquid phase to prevent icing conditions for example. At the same time during arc interruption itself metal tank 24 provides a sufficient pressure so that except around the arc 23 itself the interrupting liquid is maintained in an essentially liquid condition. However, this may not be absolutely necessary for some conditions of operation.

Figure 2:
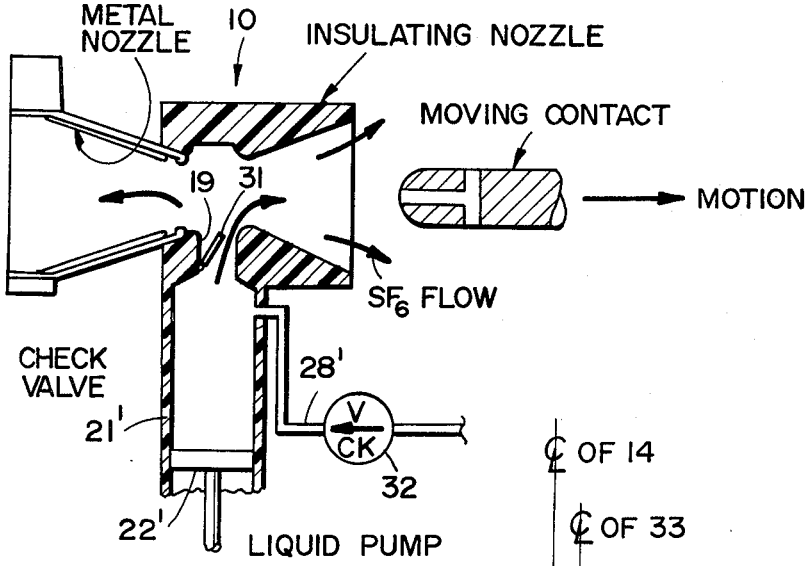
FIG. 2 is an alternative embodiment of FIG. 1.

FIG. 2 shows an alternative construction of FIG. 1 where only the parts modified are shown. That is, in aperture 19, a check valve 31 is included which closes when the pump piston is retracted to allow the cylinder to be refilled. This provides for multiple operation where a number of arcs are desired to be interrupted. A check valve 32 is also provided in the line 28' from the storage unit (not shown) which enters cylinder 21' at its upper end. In operation, liquid $SF_6$ for the next open operation is drawn into the pump cylinder on the previous close stroke. This provides for a cylinder 21' with smaller capacity compared to FIG. 1 where the cylinder capacity is sufficient for multiple operation.

Figure 3:
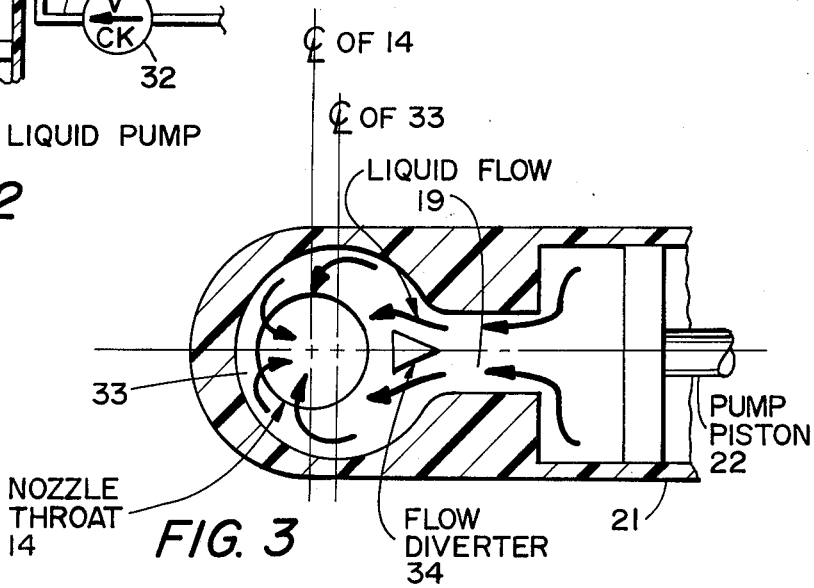
FIG. 3 is a cross-sectional view of a alternative design of a portion of FIG. 1.
Figure 4:
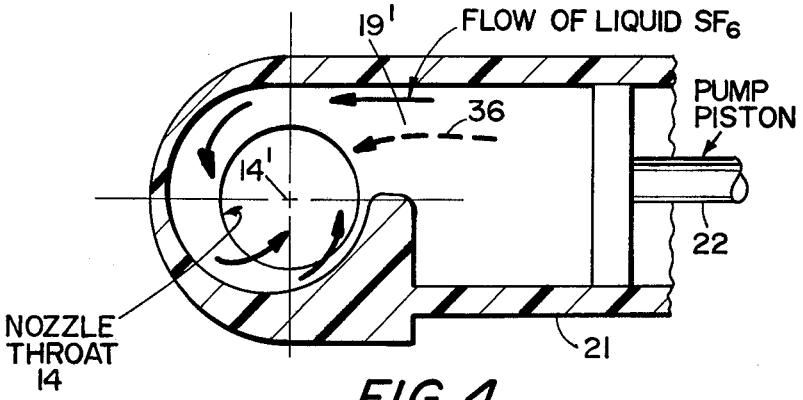
FIG. 4 is a cross-sectional view of an alternative design of a portion of FIG. 1.
Figure 5:
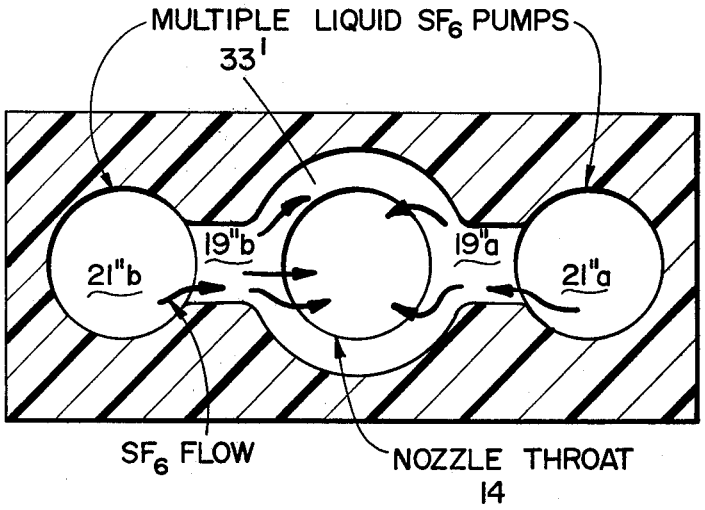
FIG. 5 is a cross-sectional view of an alternative design of a portion of FIG. 1.

Uniform liquid flow into the nozzle region can be obtained in several ways. FIGS. 3 through 6 show representative schemes. In FIG. 3 the nozzle throat 14 includes an interior circumferential channel 33 connected to aperture 19 for providing uniform liquid flow around the circumference of the nozzle. It also includes a flow diverter 34 substantially in the center of aperture 19 for splitting and directing the liquid flow into opposite halves of channel 33. By offsetting the horizontal centerline of channel 33 to the right of the horizontal centerline of nozzle 14 a uniform flow velocity is provided around the circumference of the nozzle. In FIG. 4, an aperture 19' connecting the cylinder 21 to the nozzle throat 14 is offset from the centerline 14' of the nozzle throat as indicated by the aperture center 36 which provides an off center spiral flow channel. FIG. 5 shows multiple liquid $SF_6$ pumps 21''*a* and 21''*b* which are connected to nozzle 14 through apertures 19''*a* and 19''*b*. A circumferential flow channel 33' is also provided.

Figure 6:
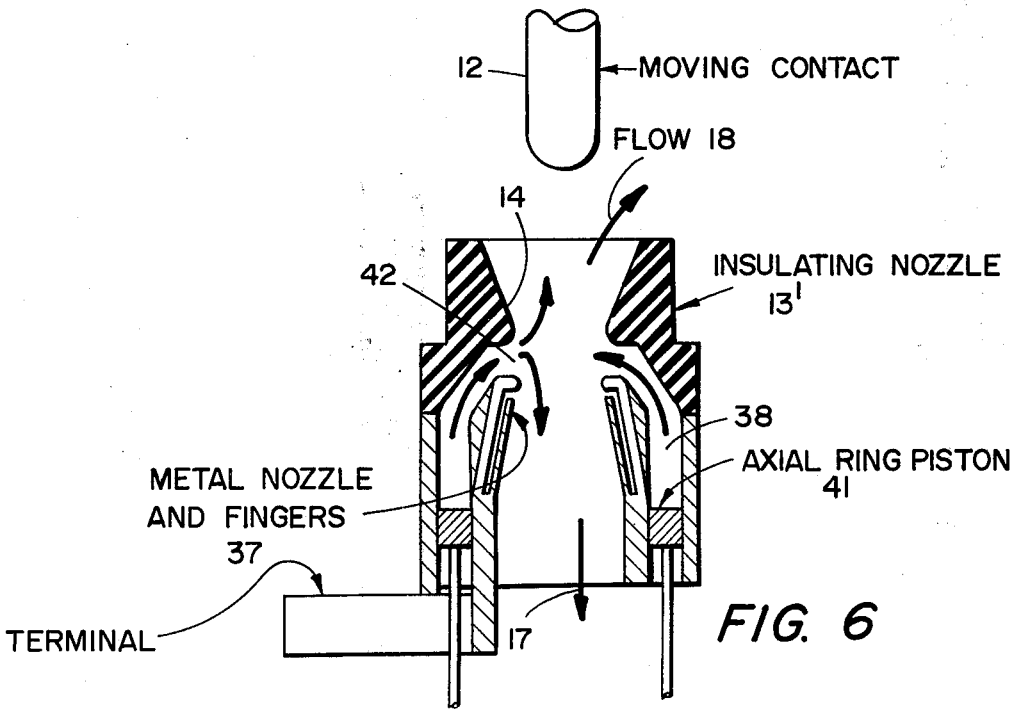
FIG. 6 is a cross-sectional view of an alternative design of a portion of FIG. 1.

In FIG. 6 a concentric pump modification of FIG. 1 feeds the nozzle throat 14. A truncated conical fixed contact configuration forming metal nozzle and fingers 37 similar to FIG. 1 are provided. However around its periphery is formed a ring type cylinder 38 with the other wall of the cylinder being formed by an extension 39 of insulating nozzle 13'. A ring piston 41 provides the necessary pressure for introduction of the fluid into the nozzle throat when the moving contact 12 is parted to allow the aperture 42 to be opened. A suitable external $SF_6$ liquid storage unit would be supplied but is not shown.

Thus, an improved liquid circuit interrupter using a minimum of dielectric liquid has been shown.

What is claimed is:

1. A circuit interrupter using a minimum of dielectric liquid having a low critical temperature at which it becomes gaseous relative to ambient temperature comprising: fixed contact means; an electrical and thermal insulating nozzle having a nozzle throat and an aperture in the side wall of said nozzle; a movable contact normally inserted in said nozzle throat and into electrical contact with said fixed contact means, said movable contact normally closing said aperture; an insulated cylinder for containing a predetermined quantity of said liquid having one end connected to said aperture in said side wall of said nozzle and the other end to a pump piston; liquid storage means having a pressure above ambient pressure permanently connected to said cylinder by a pipeline for filling said cylinder with said liquid at a relatively slow rate including cooling means for said storage means for maintaining said liquid in said storage means, in said pipeline, and in said insulating cylinder below said critical temperature in its liquid phase; said moving contact which normally closes said aperture when withdrawn allowing said predetermined quantity of liquid to flow, in response to actuation of said pump piston, through said nozzle throat at a relatively high rate to extinguish any arc created by said withdrawal of said contact.

2. A circuit interrupter as in claim 1 where said aperture includes a check valve which closes when said pump piston is retracted to allow said cylinder to be refilled whereby multiple operation is provided for interrupting a plurality of arcs.

3. A circuit interrupter as in claim 1 where said nozzle includes an interior circumferential channel connected to said aperture for providing a uniform liquid flow around the circumference of said nozzle.

4. A circuit interrupter as in claim 3 where said aperture includes a flow diverter mounted substantially in its center for splitting and directing said liquid flow into opposite halves of said channel.

5. A circuit interrupter as in claim 3 where said aperture centerline is offset from the centerline of said nozzle throat.

6. A circuit interrupter as in claim 1 where said fixed contact means is formed in a truncated conical configuration with the small end of such configuration attached to said nozzle and making electrical contact with said movable contact such conical configuration also providing an additional flow path for said liquid.

7. A circuit interrupter as in claim 1 where said fixed contact means, said movable contact, said nozzle and, said insulated cylinder are all enclosed in an air-tight vessel.

* * * * *

UNITED STATES PATENT AND TRADEMARK OFFICE

CERTIFICATE OF CORRECTION

PATENT NO. : 4,288,668

DATED : September 8, 1981

INVENTOR(S) : William H. Fischer, et al

It is certified that error appears in the above-identified patent and that said Letters Patent is hereby corrected as shown below:

Column 1, line 14, change the word "hexachloride" to --hexafluoride--.

Signed and Sealed this

Tenth Day of August 1982

[SEAL]

Attest:

GERALD J. MOSSINGHOFF

Attesting Officer

Commissioner of Patents and Trademarks